US006565366B1

(12) United States Patent
Wu

(10) Patent No.: US 6,565,366 B1
(45) Date of Patent: May 20, 2003

(54) ELECTRICAL CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/227,060

(22) Filed: Aug. 22, 2002

(51) Int. Cl.[7] ..... H01R 12/00

(52) U.S. Cl. ..... 439/76.1; 439/607; 439/687; 439/696; 439/906

(58) Field of Search ..... 439/76.1, 687, 439/696, 906, 607

(56) References Cited

U.S. PATENT DOCUMENTS 5,836,774 A * 11/1998 Tan et al. ..... 439/76.1
6,036,507 A * 3/2000 Knighton et al. ..... 439/79
6,162,068 A * 12/2000 Wu ..... 439/79
6,162,091 A * 12/2000 Kurotori ..... 439/567
6,341,964 B1 * 1/2002 Yu ..... 439/79

* cited by examiner

*Primary Examiner*—Tho D. Ta
*Assistant Examiner*—Truc Nguyen
(74) *Attorney, Agent, or Firm*—WeiTe Chung

(57) ABSTRACT

An electrical connector (1) includes an interconnecting part (10), a pair of upper and lower base plates (20) enclosing the interconnecting part, and a latching mechanism (30) attached to the lower base plate for latching and releasing a complementary connector. The interconnecting part has a dielectric body (12) and an circuit board (14) attached to the dielectric body. The circuit board forms on opposite ends thereof a plurality of gold fingers (17) for mating with the complementary connector and a plurality of soldering pads (19) for electrically connecting to corresponding conductive wires of a cable.

1 Claim, 8 Drawing Sheets

ELECTRICAL CONNECTOR

CROSS-REFERENCE TO RELATED APPLICATION

This application is a co-pending application of U.S. patent application Ser. No. 10/210,129 filed Jul. 31, 2002, entitled "ELECTRICAL CONNECTOR HAVING A LATCH MECHANISM", invented by the same inventor, assigned to the same assignee as the present application. The disclosures of the co-pending application is wholly incorporated herewith by reference.

BACKGROUND OF THE INVENTION

1. Field of the Invention

The present invention relates to an electrical connector, and particularly to a cable connector having a circuit board with a first end for electrically connecting with a cable and an opposite second end for connecting with a complementary connector.

2. Description of Related Art

As the demand for high bandwidth and low latency in computer technology increases, the emerging InfiniBand™ architecture is being developed by the information industry. InfiniBand architecture de-couples an I/O subsystem from memory by utilizing point-to-point connections rather than a shared bus. InfiniBand products are ideally suited for clustering, I/O extension, and native attachment in many network applications and can be used in high-performance server applications, providing a cost-effective transition from existing technologies.

Referring to FIG. 9, an interconnecting part 6 of an InfiniBand electrical connector in accordance with the co-pending application is shown. The connector further comprises a pair of upper and lower base plates (not shown) for enclosing the interconnecting part 6 and a latching member (not shown) for latching/releasing with/from a complementary connector (not shown). The interconnecting part 6 further has a dielectric body 61 forming a mating tongue 62, a plurality of conductive contacts 64 retained in the mating tongue 62, and a circuit board 63 attached to the dielectric body 61. Each contact 64 has a mating portion 65 received in a corresponding passageway 67 defined in the mating tongue 62 for mating with the complementary connector and a soldering portion (not shown) for soldering to a corresponding soldering pad 66 formed on one end 632 of the circuit board 63. The other end 634 of the circuit board 63 is adopted for electrically connecting with a cable (not shown). However, it is relatively complicated in manufacturing and assembling the contacts 64 to the passageways 67 in the mating tongue 62, and soldering the contacts 64 to the circuit board 63.

Hence, an improved InfiniBand electrical connector is required to overcome the disadvantages of the related art.

BRIEF SUMMARY OF THE INVENTION

A first object of the present invention is to provide an InfiniBand electrical connector having an improved interconnecting part effectively transmitting powers or signals between two electronic components.

A second object of the present invention is to provide an electrical connector having an improved interconnecting part which is simple in manufacturing and assembly.

To fulfill the above-mentioned objects, an InfiniBand electrical connector in accordance with the preferred embodiment of the present invention includes an interconnecting part, a pair of upper and lower base plates enclosing the interconnecting part, and a latching mechanism attached to the lower base plate for latching and releasing a complementary connector. The interconnecting part has a dielectric body and a circuit board attached to the dielectric body. The circuit board forms on opposite ends thereof a plurality of gold fingers for mating with the complementary connector and a plurality of soldering pads for electrically connecting to corresponding conductive wires of a cable. The lower base plate forms upwardly extending posts fitting into the circuit board, thereby preventing the circuit board from moving horizontally. Furthermore, the upper and lower base plates securely sandwich the circuit board therebetween, thereby preventing the circuit board from moving vertically so that the golden fingers of the circuit board can reliably engage with the complementary connector.

Other objects, advantages and novel features of the invention will become more apparent from the following detailed description of the present embodiment when taken in conjunction with the accompanying drawings.

DETAILED DESCRIPTION OF THE INVENTION

Figure 1:
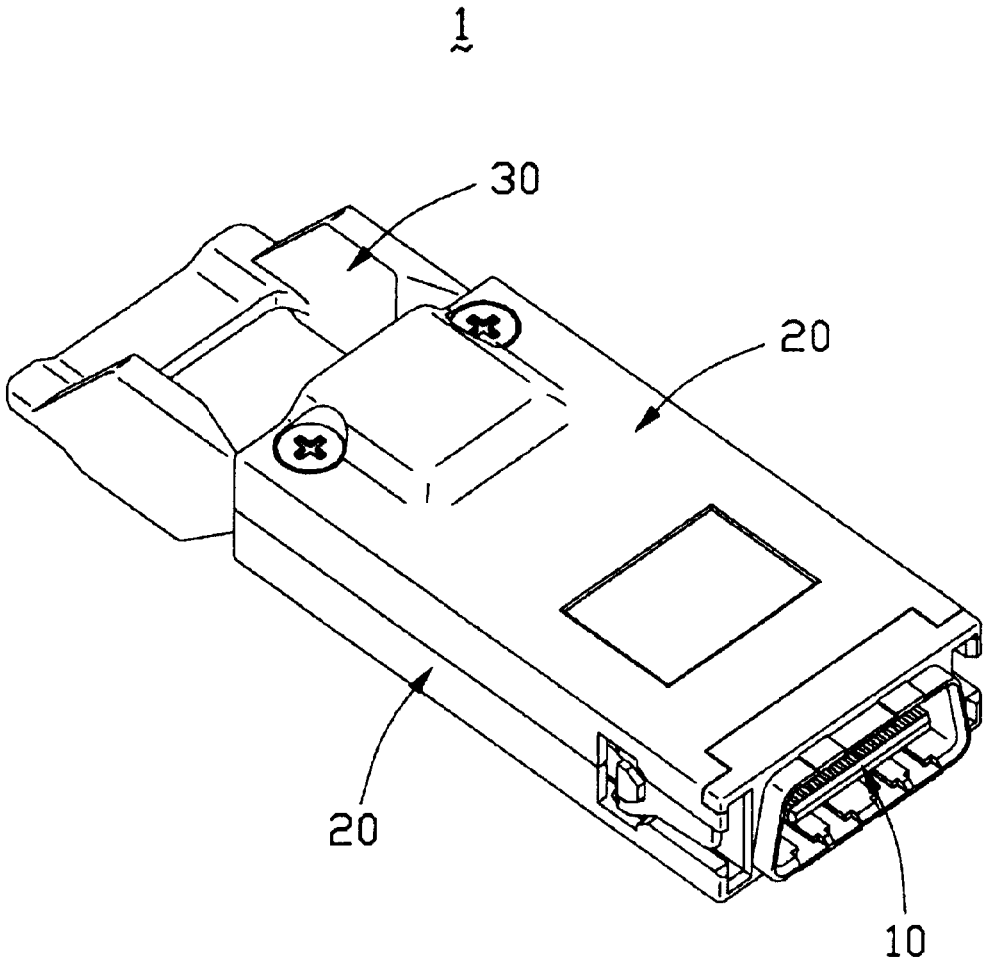
FIG. 1 is a perspective view of an electrical connector in accordance with the present invention.

Reference will now be made to drawings, and particularly to FIG. 1, an InfiniBand electrical connector 1, named as an Infiniband product, in accordance with the preferred embodiment of the present invention comprises an electrical interconnecting part 10, a pair of upper and lower base plates 20 enclosing the interconnecting part 10, and a latching mechanism 30 coupled between the upper and lower base plates 20 for latching/releasing a complementary connector (not shown) with/from the electrical connector 1.

It is noted that the upper and lower base plates 20 and the latching mechanism 30 are detailedly described in the co-pending application which is wholly incorporated herewith by reference. Thus, the upper and lower base plates 20 and the latching mechanism 30 are only briefed below.

Figure 2:
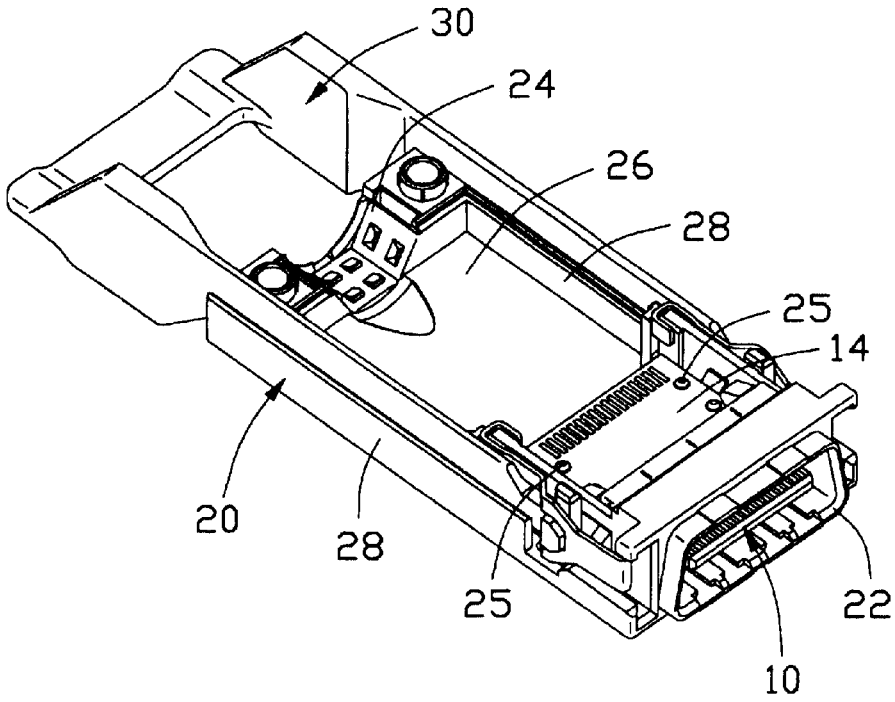
FIG. 2 is a partial perspective view of FIG. 1 with an upper base plate thereof removed therefrom.
Figure 7:
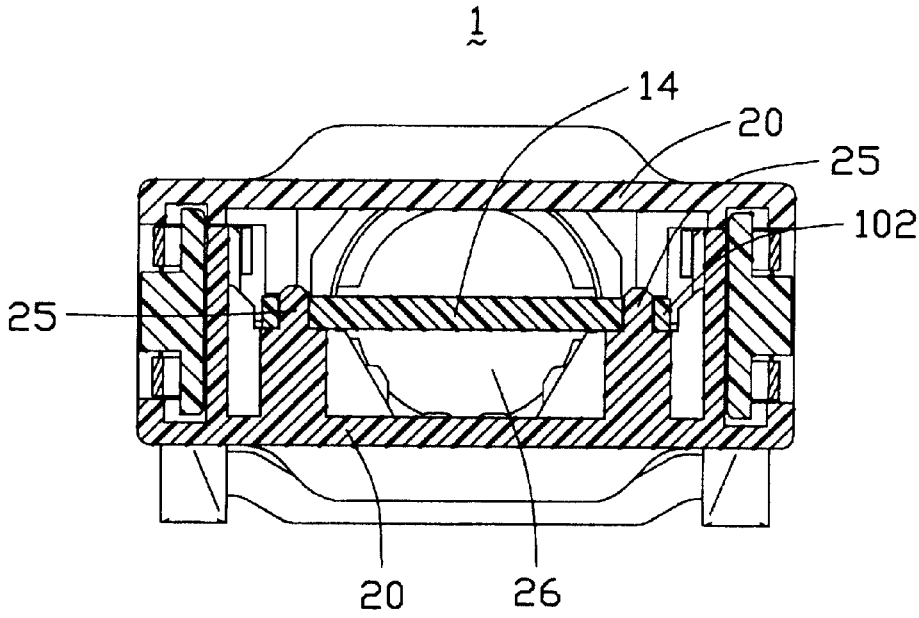
FIG. 7 is another cross-sectional view of FIG. 1.
Figure 8:
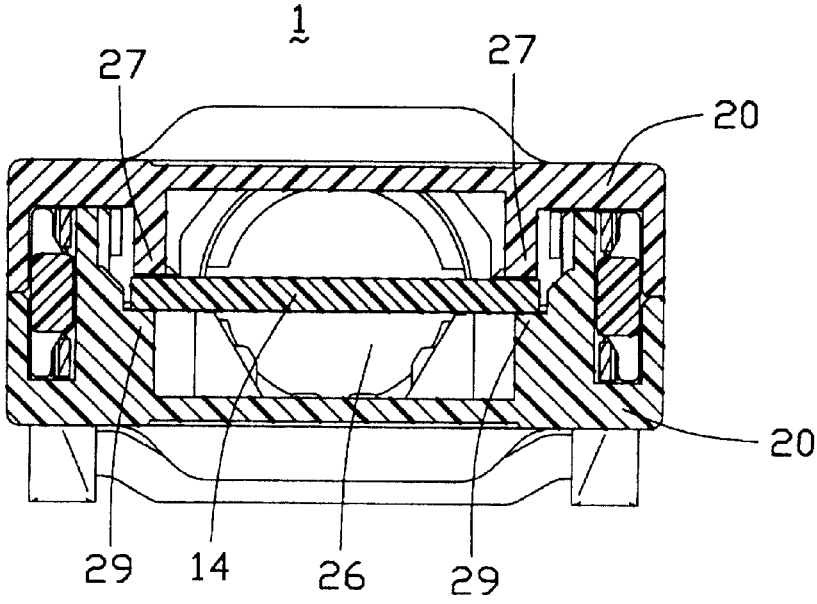
FIG. 8 is still another cross-sectional view of FIG. 1.
Figure 9:
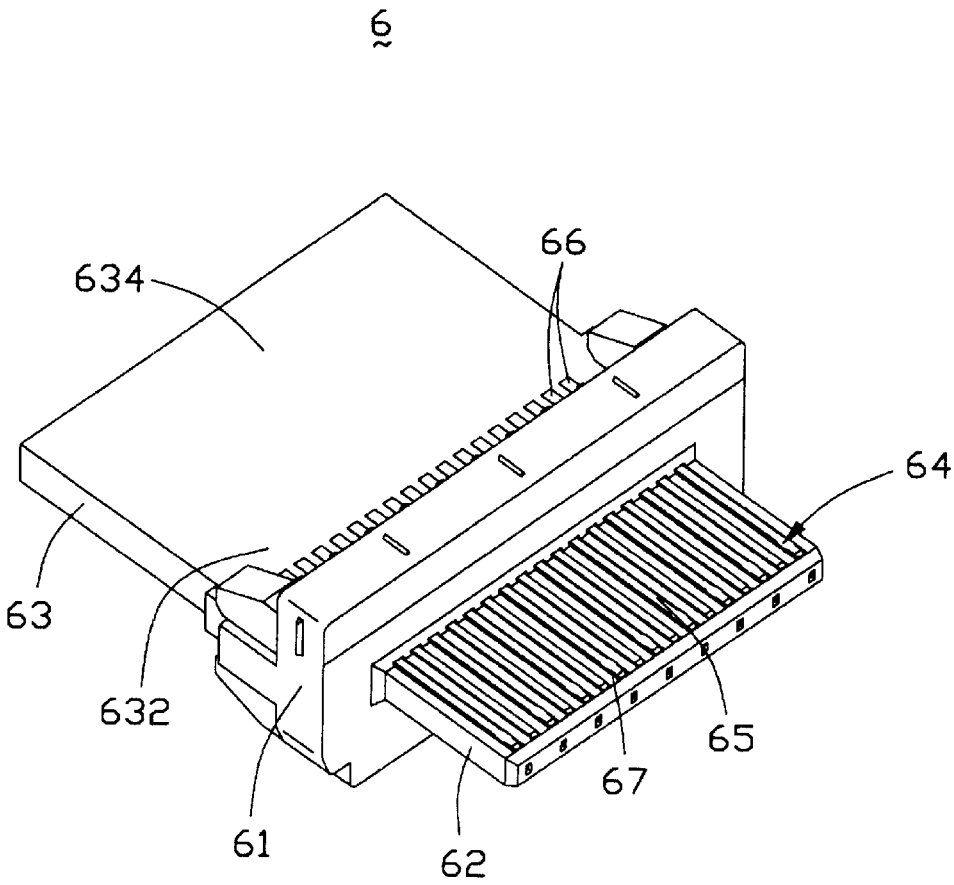
FIG. 9 (RELATED ART)
FIG. 9 is a perspective view of an interconnecting part of an InfiniBand electrical connector of related art.

Further referring to FIGS. 2, 7 and 8, the upper and lower base plates 20, formed by die-casting, are coupled to each other. The lower base plate 20 forms a mating port 22 and a receiving port 24 at opposite ends thereof. The mating port 22 is for receiving the complementary connector and the receiving port 24 is for extension of a cable (not shown) therethrough. The lower base plate 20 further defines a chamber 26 between the mating and the receiving ports 22, 24 and comprises a pair of side walls 28 for receiving the interconnecting part 10 and the cable. Additionally, the upper base plate 20 forms a pair of upper projections 27 and the lower base plate 20 forms a pair of lower shoulders 29 which are spaced apart from the upper projections 27 with a predetermined distance. Furthermore, the lower base plate 20 forms four posts 25 extending into the chamber 26 thereof.

Figure 3:
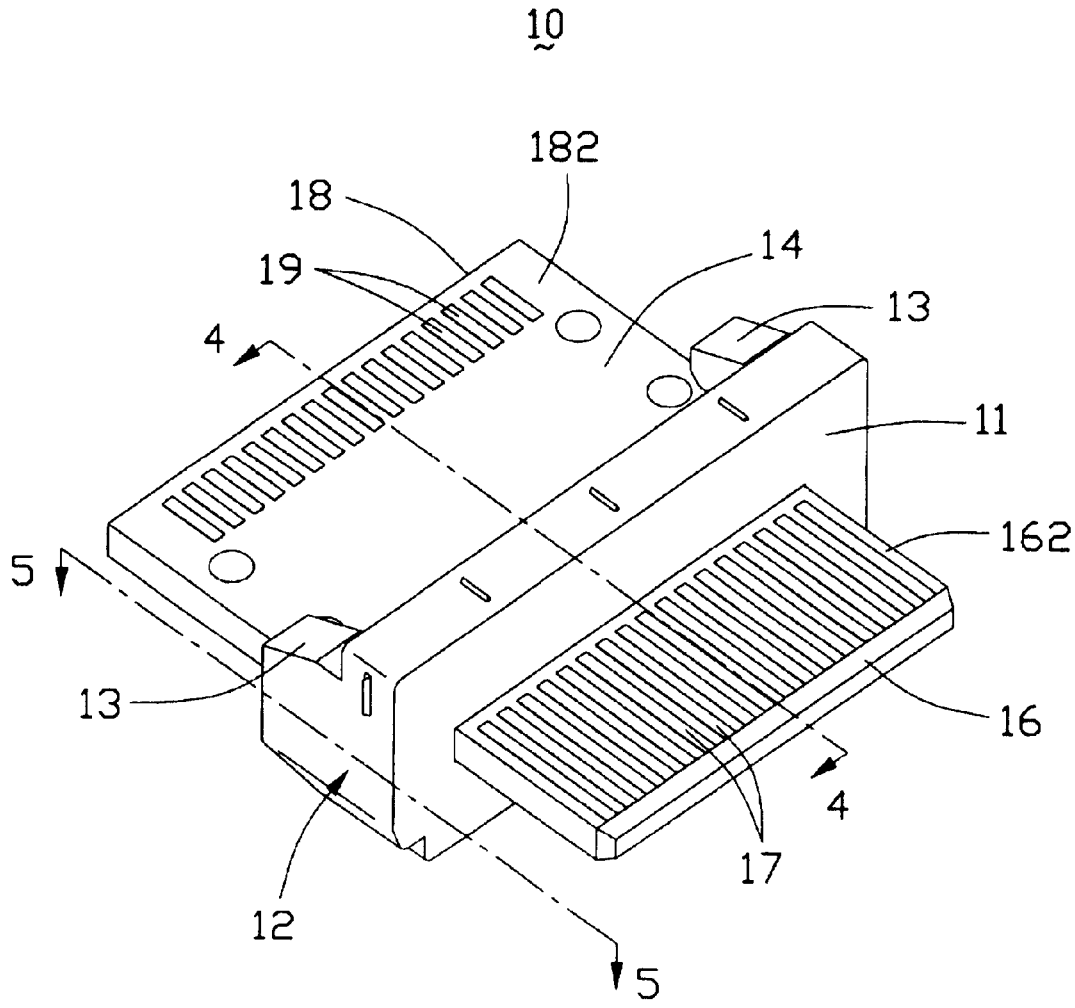
FIG. 3 is an enlarged perspective view of an interconnecting part of the electrical connector of FIG. 1.
Figure 4:
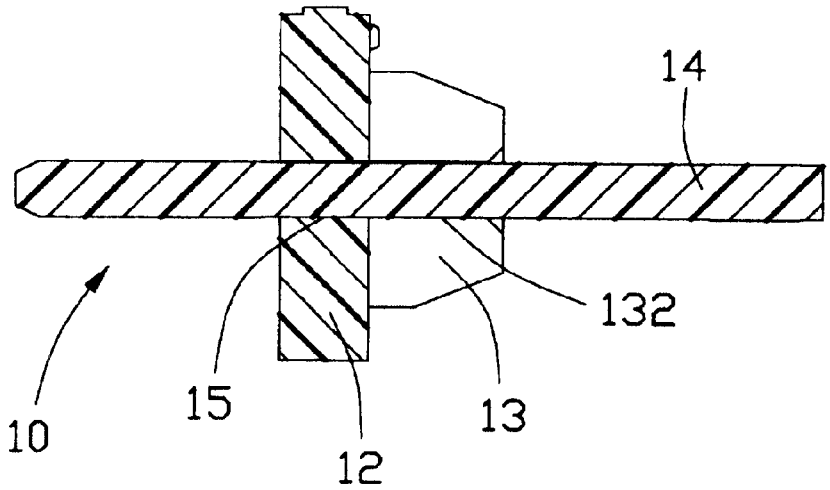
FIG. 4 is a cross-sectional view taken along line 4—4 of FIG. 3.
Figure 5:
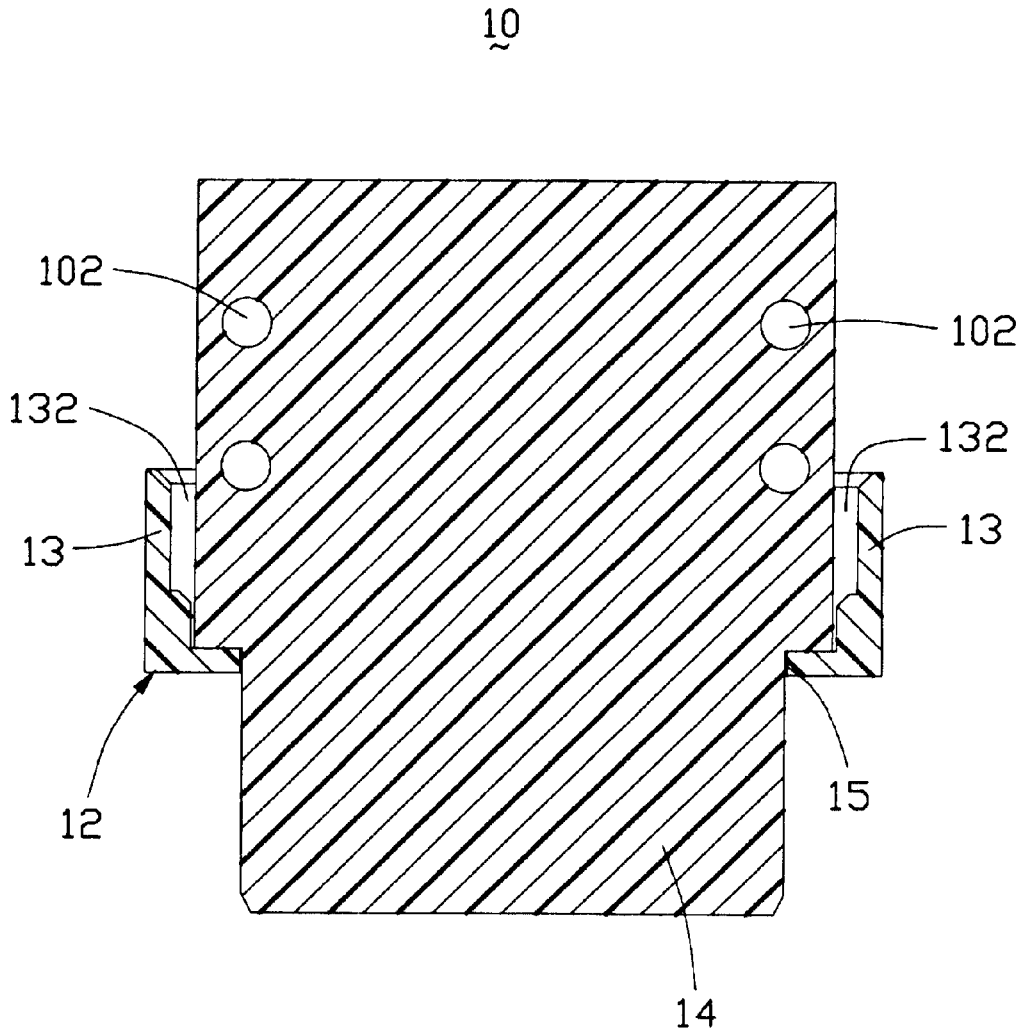
FIG. 5 is a cross-sectional view taken along line 5—5 of FIG. 3.

Further referring to FIGS. 3 to 5, the interconnecting part 10 includes a dielectric body 12 and a circuit board 14 retained to the dielectric body 10. The dielectric body 12 has an elongated body 11 and a pair of side wings 13 extending from opposite ends of the elongated body 11. The elongated body 11 defines a through hole 15 extending through opposite sides thereof. Each side wing 13 defines a slot 132 in an inner surface thereof for interferingly receiving a corresponding side edge of the circuit board 14 to thereby retain the circuit board 14 in position. The circuit board 14 forms a mating portion 16 and a soldering portion 18 at opposite ends thereof. The mating portion 16 forms a plurality of gold fingers 17 on a top face 162 thereof for conductively contacting with corresponding terminals (not shown) of the complementary connector. The soldering portion 18 forms a corresponding number of soldering pads 19 on a top face 182 thereof for being soldered to corresponding conductive wires (not shown) of the inserted cable. The circuit board 14 further defines four post holes 102 in opposite sides thereof for engaging with corresponding posts 25 formed on the lower base plate 20 to thereby retain the interconnecting part 10 in place.

Figure 6:
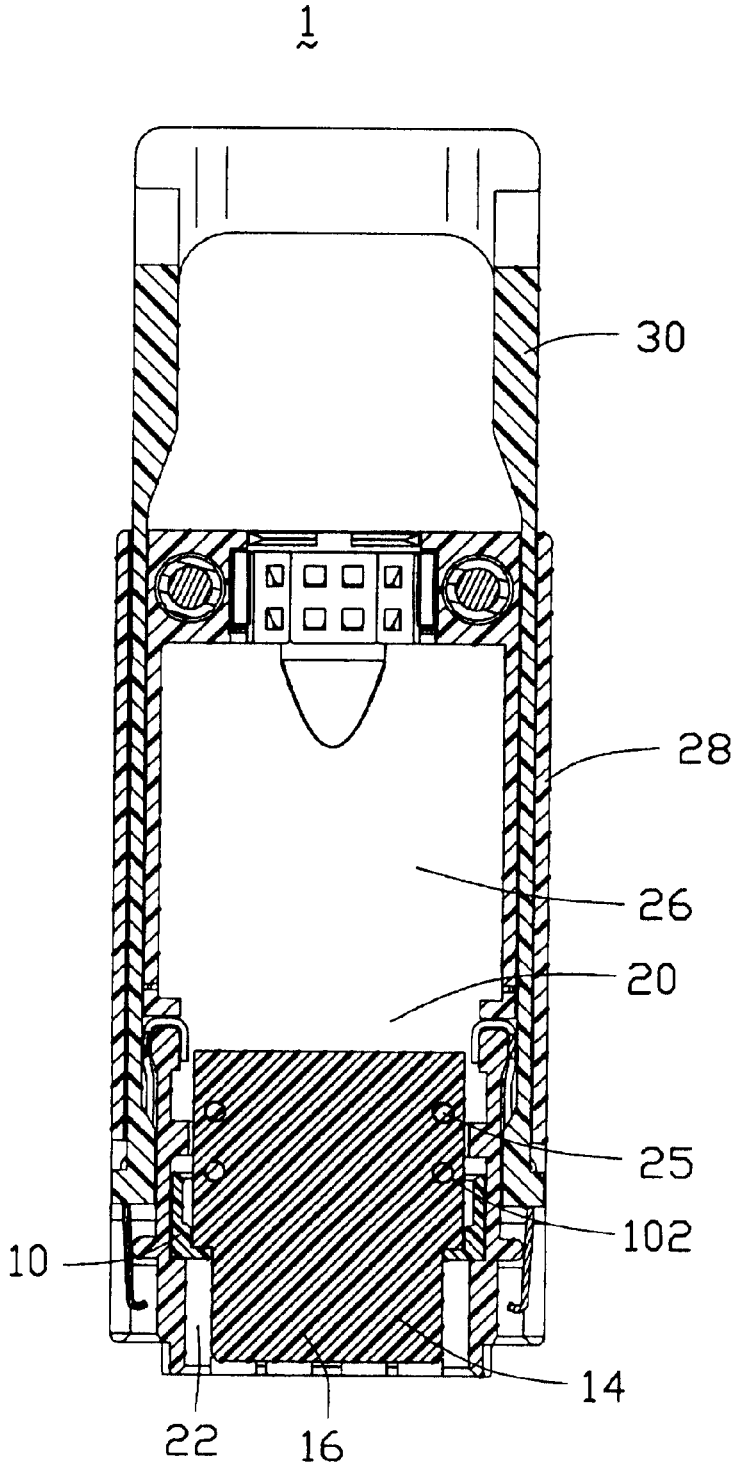
FIG. 6 is a cross-sectional view of FIG. 1.

Further referring to FIG. 6, in assembly, the interconnecting part 10 is fitted into the lower base plate 20, and the mating portion 16 thereof is slide into the mating port 22. The post 25 of the lower base plate 20 fit into the post holes 102 of the circuit board 14, thereby preventing the interconnecting part 10 from moving back and forth with respect to the upper and lower base plates 20. Additionally, the circuit board 14 is securely sandwiched between the upper projections 27 of the upper base plate 20 and the lower shoulders 29 of the lower base plate 20 (FIG. 8), thereby preventing the interconnecting part 10 from moving upwardly and downwardly with respect to the upper and lower base plates 20 during mating of the electrical connector 1 with the complementary connector. In this way, the electrical connector 1 in accordance with the present invention provides an interconnecting part 10 which is simple in structure while provides secure and effective electrical connections with the complementary connector and the cable. Furthermore, since in the electrical connector 1 in accordance with the present invention, unlike the related art, there is no need to use contacts and assembling the contacts to an interconnecting part and soldering the contacts to a circuit board, the electrical connector 1 is advantageous over the related art connector in view of the manufacturing cost. Anyhow, it should be noted that the securement among the circuit board 14, the dielectric body 12 and upper and lower plates 20 is also different from what used in the prior art for compliance with such contact omission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an interconnecting part having a dielectric body and a circuit board attached to the dielectric body, the circuit board forming on opposite ends thereof a plurality of gold fingers for mating with a complementary connector and a plurality of soldering pads for electrically connecting to corresponding conductive wires of a cable;

a pair of upper and lower base plates enclosing the interconnecting part; and a latching mechanism attached to the lower base plate for latching and releasing the complementary connector; and wherein the dielectric body of the interconnecting part has an elongated body defining a through hole for receiving the circuit board; and wherein a pair of side wings extends from on opposite ends of the elongated body and each side wing defines a slot for receiving a corresponding side edge of the circuit board; and wherein the lower and upper base plates are formed by die-casting and coupled with each other; and wherein the lower base plate forms at opposite ends thereof a mating port for receiving one end of the circuit board having the plurality of gold fingers and a receiving port for insertion of the cable and defines a chamber between the mating port and the receiving port for receiving the interconnecting part; and wherein the lower base plate forms at least one post extending into the chamber; and wherein the circuit board defines at least one post hole with which the at least one post engages; and wherein the upper base plate forms at least one upper projection and the lower base plate forms a lower shoulder aligned with and spaced from the at least one upper projection for sandwiching the circuit board therebetween.

* * * * *